US005755451A

United States Patent [19]

O'Connor

[11] Patent Number: 5,755,451

[45] Date of Patent: May 26, 1998

[54] BOAT PORTAGE DOLLY

[76] Inventor: Michael A. O'Connor, 24065 Vista Corona, Dana Point, Calif. 92629

[21] Appl. No.: 626,369

[22] Filed: Apr. 2, 1996

[51] Int. Cl.[6] ..... B62B 1/04

[52] U.S. Cl. ..... 280/47.32; 280/47.331

[58] Field of Search ..... 280/47.331, 47.3, 280/47.32, 78, 767, 414.1, 414.2; 403/245, 256; 256/65

[56] References Cited

U.S. PATENT DOCUMENTS

| | | | |
|---|---|---|---|
| D. 314,463 | 2/1991 | Harms | D34/28 |
| 2,709,084 | 5/1955 | Nagaishi | 280/47.32 |
| 2,774,607 | 12/1956 | Palmer | 280/47.3 |
| 2,967,719 | 1/1961 | Williams | 280/47.331 |
| 3,129,965 | 4/1964 | Stark | 403/315 |
| 3,217,478 | 11/1965 | De Geere | 280/47.32 |
| 3,361,441 | 1/1968 | McRae | 280/47.32 |
| 3,659,868 | 5/1972 | Tucker | 280/47.32 |
| 3,687,476 | 8/1972 | Abbott | 280/47.32 |
| 3,697,096 | 10/1972 | Hadley | 280/47.32 |
| 3,831,211 | 8/1974 | Bustamante | 280/47.32 |
| 3,857,128 | 12/1974 | Gilster | 280/47.32 |
| 4,059,282 | 11/1977 | Prickett | 280/47.13 B |
| 4,396,343 | 8/1983 | Brewer, Jr. | 280/47.331 |
| 4,538,952 | 9/1985 | Chase | 414/458 |
| 4,601,481 | 7/1986 | Maurice | 280/47.13 B |
| 4,615,534 | 10/1986 | Blain | 280/47.331 |
| 5,000,468 | 3/1991 | Weinstein | 280/47.34 |
| 5,372,354 | 12/1994 | Cacicedo | 256/65 |
| 5,458,428 | 10/1995 | West | 403/256 |

FOREIGN PATENT DOCUMENTS

| | | | |
|---|---|---|---|
| 2021048 | 11/1979 | United Kingdom | 280/47.32 |

*Primary Examiner*—Randolph A. Reese
*Assistant Examiner*—John L. Beres
*Attorney, Agent, or Firm*—Gordon K. Anderson

[57] ABSTRACT

A boat portage dolly for a boat that includes mounting gudgeons (30) on the transom (34), the dolly having a bifurcated carriage (20) with downwardly distending legs (22) attached to an upright frame member (24). The upright member also contains a pair of apertures (28) and an axle (36) is attached between the distal end of the legs. A wheel (40), preferably including a pneumatic tire, is rotatably mounted on the axle. The dolly is mated to the boat by placing the apertures over the gudgeons and penetrating holes in the gudgeons with a bent rod (44) that is contiguous with the inner surface of the carriage, holding the dolly in place tightly against the transom of the boat. The boat is portaged to water by lifting the bow by a single person and wheeling the vessel wheelbarrow fashion. Other embodiments change construction techniques of the carriage and retaining means.

3 Claims, 3 Drawing Sheets

BOAT PORTAGE DOLLY

TECHNICAL FIELD

The present invention relates to boat dollies in general. More specifically to dollies that attach to boats having a pair of rudder receiving gudgeons or eyes.

BACKGROUND ART

Previously, many types of dollies have been used in endeavoring to provide an effective means for producing easy portage of small boats. Some use multiple wheels with a frame to secure the entire hull, while others utilize a pair of wheels strapped to the bottom of the hull. An attempt to keep simplicity is embodied in a single wheel under the hull or on an inverted boat at the bow with manual lifting required. Still others use a pair of wheels on a separate dolly that provides maneuverability by steering the dolly itself.

A search of the prior art did not disclose any patents that read directly on the claims of the instant invention, however, the following U.S. patents are considered related:

| U.S. Pat. No. | Inventor | Issue Date |
|---|---|---|
| Des. 314,463 | Harms | Feb. 5, 1991 |
| 5,000,468 | Weinstein | Mar. 19, 1991 |
| 4,601,481 | Maurice | Jul. 22, 1986 |
| 4,538,952 | Chase | Sep. 3, 1985 |
| 5,059,282 | Prickett | Nov. 22, 1977 |
| 3,687,476 | Abbott | Aug. 29, 1972 |

Harms, in Design Pat. No. 314,463, illustrates a launching dolly for a boat that forms a tongue extension for a boat trailer.

U.S. Pat. No. 5,000,468 issued to Weinstein teaches a transporting dolly for a boat in a laterally vertical orientation. The dolly has spaced frame members that cradle the boats hull inbetween and has a two or four wheel embodiment. In operation the dolly is pulled or lifted for portability.

Maurice, in U.S. Pat. No. 4,601,481, discloses a removable boat dolly that includes a pair of wheel support units. A mounting strap hooks over the gunwales of the boat and levers provide and maintain tension for spacing and frictional engagement with the hull.

U.S. Pat. No. 4,538,952, of Chase, is for a mobile straddle type boat dolly for commercial fishing boats. The dolly includes a structural frame and a number of over-the-road wheels. The dolly includes a self-contained fluid actuating system for lift pads.

Prickett, in U.S. Pat. No. 4,059,282, is directed to a dolly for wheeling a boat to the water from a car. The dolly has a bracket that is removably received by a slot within a mounting plate secured to the bow of the boat. The boat is turned upside down for transportation.

U.S. Pat. No. 3,687,476, issued to Abbott, is for a single wheeled cushion dolly that mounts under the hull of a boat for wheeling the boat to the water. The dolly has an adjustable cross-member for different sized hulls and spring loaded cables attached to opposite gunwales of the boat.

DISCLOSURE OF THE INVENTION

It has historically been a problem to transport a small boat from a vehicle to the water. Even if the boat itself is little and relatively light in weight, it is awkward due to its physical shape and configuration. In most cases, if two people are present it may be lifted by hand and carried by one person on each side. As sailing is a very popular sport in the United States, with some 3.8% of the adult population engaging in some sort of sailing activity, the need has arisen to make portage of small boats easier, particularly for one person.

The small sailing craft in the Sabot class, which is a boat having a sideboard with a heeled weight of not less than 95 pounds (241 kg), is a prime example. It is small enough to be carried on an automobile roof or in the bed of a pick-up truck, but is extremely awkward for a single person to portage to the water. Further, some prior art has dollies that many function properly when the hull is turned upside down, however, this means that any ancillary equipment, such as cushions, pads, oars, rudder, etc., must be removed prior to transportation. Still others have developed dollies that mount under the hull, again providing difficulty in attachment for the single person, as the boat must be lifted or turned on either side for attachment and removal.

It is, therefore, a primary object of the invention to provide a simple, easily attachable device that may be used by a single person. This object eliminates damage to the boat when handling or, if it is necessary, to be dragging on the ground when no one is around to help.

An important object of the invention is that a Sabot class boat requires no modification at all, as a pair of rudder gudgeons or mounting eyes are already attached to the boats transom for receiving the rudder pins. These gudgeons are spaced apart and each have a hole in the vertical plane. Adaption to the invention is simple and easy as one simply removes the rudder, which may be already taken off for storage, positions the device over the gudgeons and slips in a bent pin through the holes nesting the device against the transom. Other boats may be modified for this apparatus by the addition of a pair of similar eyes attached to the transom. This simple alteration may be used for rowboats, or even lightweight motorboats, and the like.

Another object of the invention is the obvious method of attachment. Since the rudder has a pin, the replacement of the rudder with the dolly and the utilization of a separate pin of a similar configuration is intuitively obvious. Further, in other embodiments of the dolly with an open back, two single bent pins, hairpin cotter pins, or attached barrel bolts, may be utilized with equal ease and understanding.

Still another object of the invention is directed to the use of a large wheel, preferably including a pneumatic tire. While other wheels, such as solid rubber or semi-hermetic tires, may be used, the pneumatic tire provides a smooth ride over gravel, stones, sand, rocky hillsides, and even curbs in parking lots. The large diameter and specific height permits the user to lift the boat from the bow and push or pull it to the water in a comfortable standing or walking position.

Yet another object of the invention allows the dolly to be left attached to the boat during storage. If the boat is stored horizontally, the wheel and bow touch the floor or ground, and if tilted vertically, the wheel assumes the weight and provides an easy pivot point when moved for loading.

A further object of the invention has to do with its lightweight construction and corrosion resistance. The preferred embodiment of the invention includes aluminum for the structural carriage with stainless steel fittings, which are both known for their protection from oxidation.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred, second, and a third embodiment. All three embodiments are primarily designed for the same function and have the same dimensional outline, but differ in the manner and materials of construction.

Figure 11:
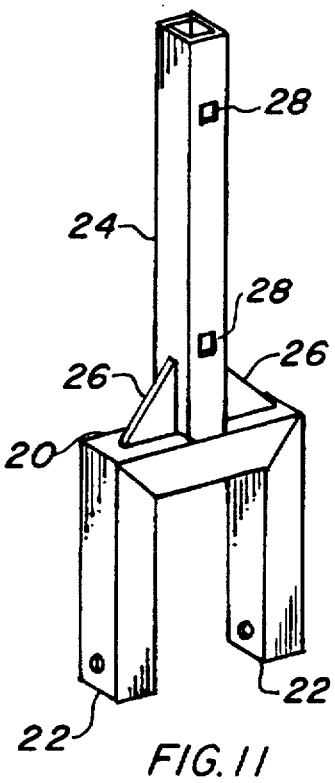
FIG. 11 is a partial isometric view with mitered corners on the legs.

The preferred embodiment, as shown in FIGS. 1 through 8 and 11, is comprised of a bifurcated carriage 20 that is attached to the transom of a boat. The carriage 20 has a pair of downwardly distending legs 22 that are attached to an upright frame member 24 in a fork-like configuration. The carriage 20 is preferably constructed using four different lengths of hollow rectangular tubes welded together to form a structural single piece weldment. A pair of triangular shaped gussets 26 are added to increase the integrity of the structure. Aluminum is the preferred material, well known for its resistance to corrosion, lightweight, and ease of welding, however, any material could be an acceptable substitute when suitable surface protection is applied after construction. The tubular members are cut square on the ends for convenience, however, the legs 22 may be mitered, as shown in FIG. 11, to improve the asthenics. The upright frame member 24 further contains a pair of gudgeon receiving apertures 28 that are slightly larger and in alignment with the rudder mounting gudgeons 30 already mounted onto a Sabot class sailboat 32, such that when the carriage 20 is placed against the transom 34 of the boat, the gudgeons 30 penetrate the holes and provide alignment and structural attaching points for the carriage. These apertures 28 are illustrated best in FIGS. 3, 5, and 7, in the preferred embodiment. It will be noted that the carriage 20 is flat on the backside, so as to fit flush with the boats transom 34 when the gudgeons 30 penetrate the apertures 28.

An axle 36 is mounted through the legs 22 at the lower end, as depicted in FIGS. 1 through 4, and is round and made of metal. While stainless steel is the preferred material, carbon steel may be used with equal ease if it is plated with a corrosion resistant layer. In order to hold the axle in place, both ends may be threaded, or one end may have an integral head.

The axle 36 is preferably retained in place by the use of a number of hex nuts 38 and washers, if required to space the axle between the legs 22 properly. Any type of nut is acceptable, such as a hexagonal nut, jamnut, locknut, etc. and the material may be plated steel, or stainless steel, etc.

A wheel 40 is mounted onto the axle 36, as shown in FIGS. 1 through 4. This wheel provides the mobility for porting the boat from the transporting vehicle to the water. The tire of the wheel may be any type well known in the art, such as solid rubber, semi-pneumatic, or pneumatic, using a metal hub to hold the tire in place. A pneumatic tire is preferred, either in it's tubed or tubeless configuration, as the qualities of a soft ride and wide footprint provide the optimum utility. The hub also includes a set of bearings for ease of rotation. All of the characteristics are, of course, well known in the art and wheels are readily obtainable.

Gudgeon retaining means removably join the apparatus to the boat by removing the boats rudder and mating the apertures 28 in the carriage 20 over the boats rudder gudgeons 30. Each gudgeon 30 has a hole 42 through which the rudder is attached by the use of a rod that slips through both gudgeons simultaneously. The invention utilizes this existing principle and attaches the carriage 20 by sizing the thickness of the upright frame member 24 to align with the edge of the hole 42 in the gudgeon. This alignment permits a bent rod 44 to be inserted into both holes 42 and retain the dolly tightly against the transom 34 of the boat. The bent rod 44, depicted by itself in FIG. 8, has a handle portion 46 on one end and a bevel 48 on the other with a slight bow 50 in the middle to retain tension. The handle portion 46 is bent at an obtuse angle preventing it from falling through the upright frame 24 and the bow 50 is just sufficient to prevent rattling and take-up the slack in the space between the rod and the hole.

Figure 10:
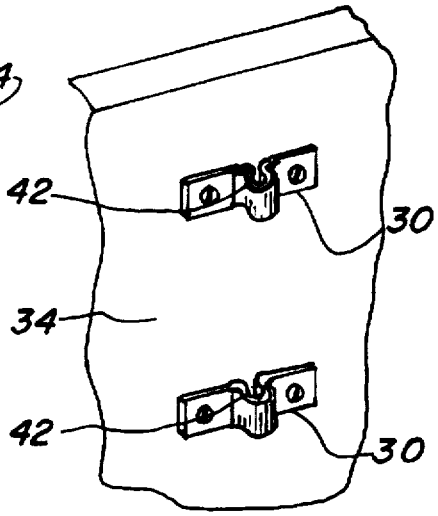
FIG. 10 is a partial isometric view of the transom of a boat with gudgeons attached.

While the invention is initially directed to a specific class of sailboat, it may be easily adapted to fit any small watercraft with equal ease and dispatch by simply adding a pair of gudgeons 30 to the transom 34 of the craft, as shown in FIG. 10. Any bracket may also be substituted provided it has a hole 42 that fits the rod 44 and the hole has the proper edge distance to interface with the carriage aperture 28. Attachment to the boat is also simple to accomplish and well known in the art. If the boat does not have a flat transom 34, the brackets may be located on any surface or modified to increase the hole location by the use of spacers, or the like.

Figure 1:
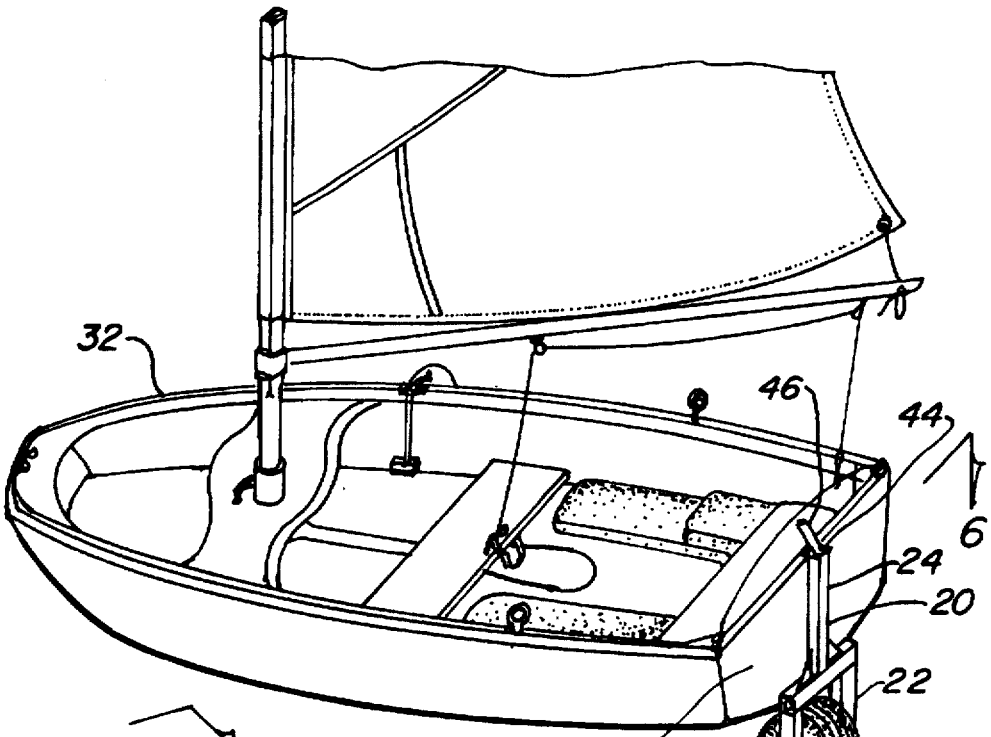
FIG. 1 is a partial isometric view of the preferred embodiment mounted on a Sabot class sailboat.
Figure 2:
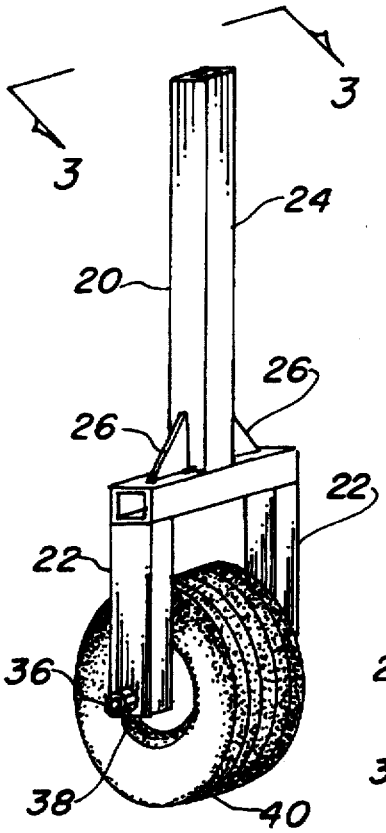
FIG. 2 is a partial isometric view of the dolly in its preferred embodiment.
Figure 3:
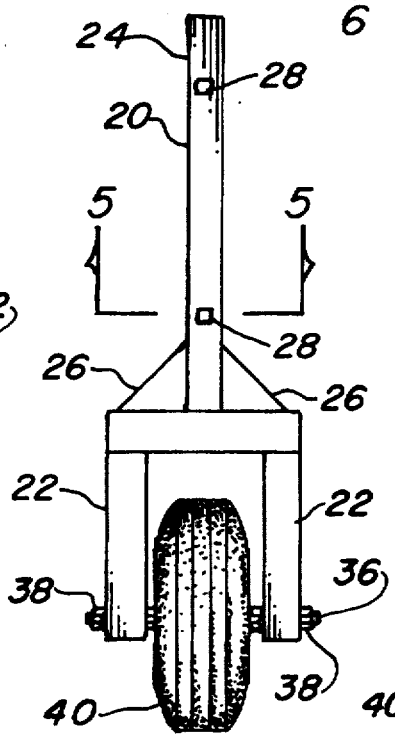
FIG. 3 is a rear view of the dolly as looking in the direction of lines 3—3 of FIG. 2.
Figure 4:
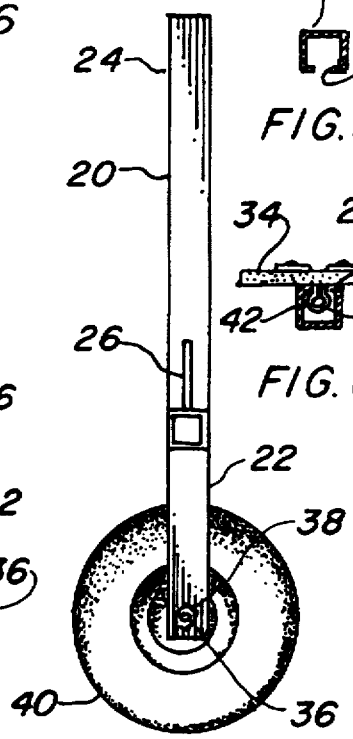
FIG. 4 is a left side view of the dolly in the preferred embodiment.
Figure 5:
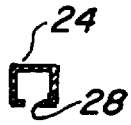
FIG. 5 is a cross-sectional view taken along lines 5—5 of FIG. 3.
Figure 6:
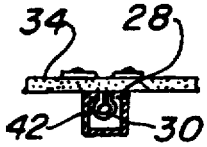
FIG. 6 is a cross-sectional view taken along lines 6—6 of FIG. 1 attached to the transom of a Sabot class sailboat.
Figure 7:
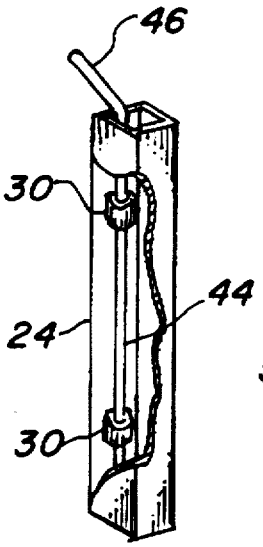
FIG. 7 is a partial isometric view cut-away to illustrate the bent pin penetrating the holes in the gudgeons.
Figure 8:
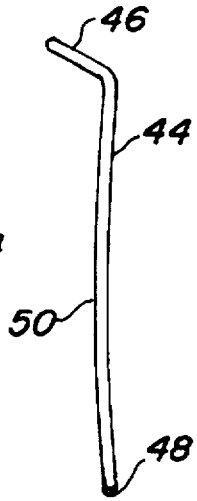
FIG. 8 is a partial isometric view of the bent rod completely removed from the invention for clarity.
Figure 9:
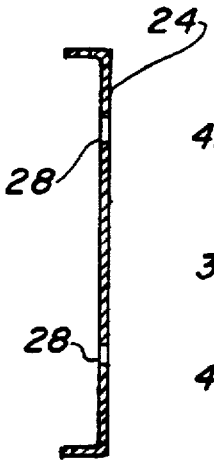
FIG. 9 is a cross-sectional view taken along lines 9—9 of FIG. 13.
Figure 12:
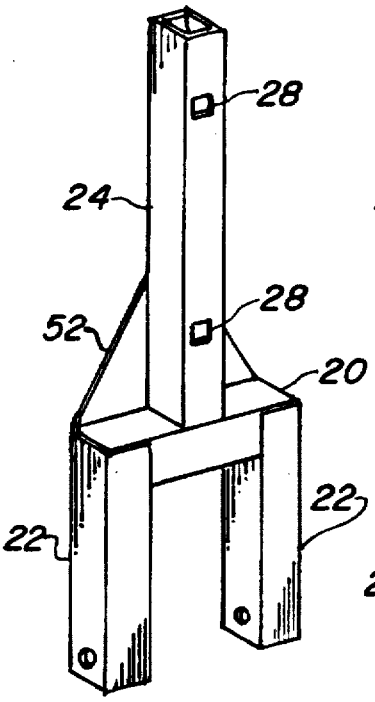
FIG. 12 is a partial isometric view of the second embodiment of the carriage showing a combination of hollow tubes and formed sheet metal.
Figure 13:
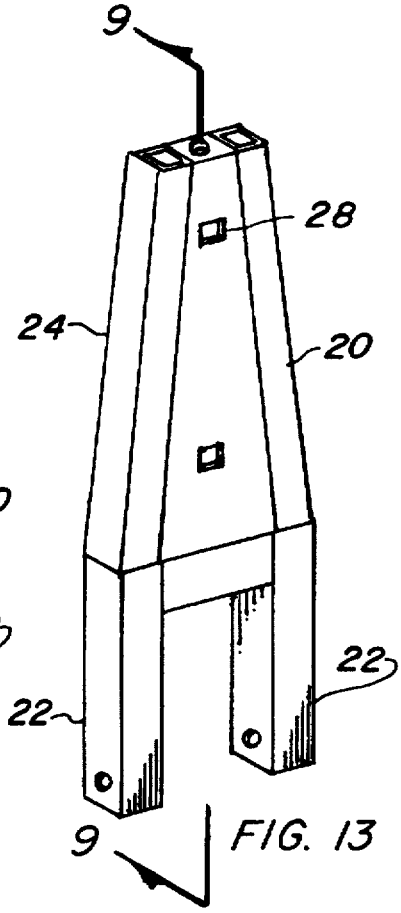
FIG. 13 is a partial isometric view of an alternate second embodiment of the carriage showing a combination of hollow tubes and formed sheet metal.

The second embodiment is illustrated in FIGS. 9, 12, and 13, and differs only in the type of construction for the bifurcated carriage 20. FIG. 12 depicts a combination of hollow rectangular tubes and formed sheet metal where the gusset is incorporated in the horizontal member 52 bent into a zee-shape, and the legs 22 and upright 24 remain the same. The horizontal member 52 is welded in place in the same manner as the preferred embodiment and, the materials with their alternates, remain unchanged. FIGS. 13 and 9 depict a similar configuration, except the legs 22 are angled inwardly and a formed plate is welded in between to form the back.

Figure 14:
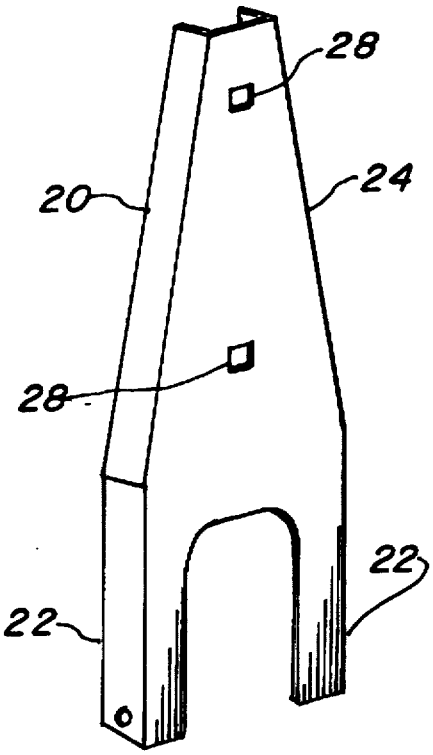
FIG. 14 is a partial isometric view of the front of the third embodiment of the carriage formed of sheet metal.
Figure 15:
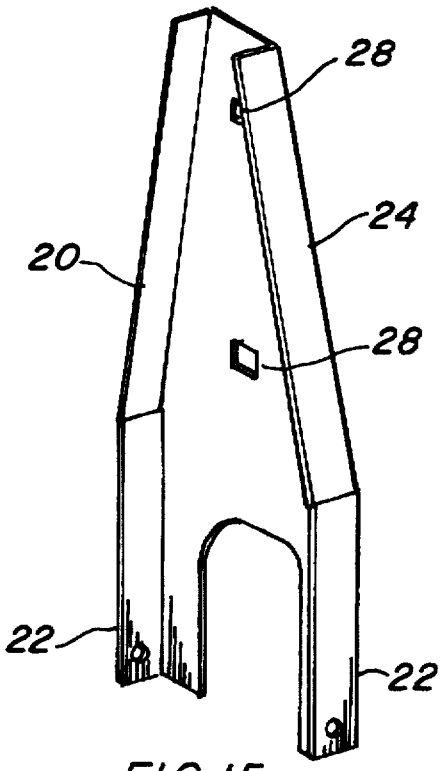
FIG. 15 is a partial isometric view of the rear of the third embodiment of the carriage formed of sheet metal.

The third embodiment is depicted in FIGS. 14 through 18 and, again, is divergent only in the carriage construction. FIGS. 14 and 15 illustrate the bifurcated carriage 20 formed of corrosion resistant sheet metal. This type of fabrication permits die cutting, or punching and notching, in the flat and forming the flanges by bending the edges upward into a structural shape. This method of construction is cost effective in large quantities and the sheet metal may be relatively thin with raised portions around the apertures 28 to compensate for material thickness. While not illustrated, the flanges forming the legs 22 and upright 24 may be bent into U-shape for further strength. The materials may be aluminum, stainless steel, or carbon steel, plated or having a zinc coating compatible with organic finishes to produce a corrosion resistant product.

Figure 16:
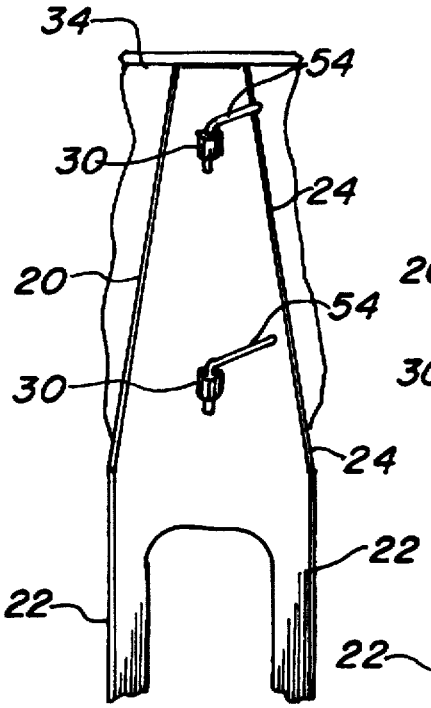
FIG. 16 is a partial isometric view of the rear of the carriage attached to the gudgeons with a pair of bent pins.
Figure 17:
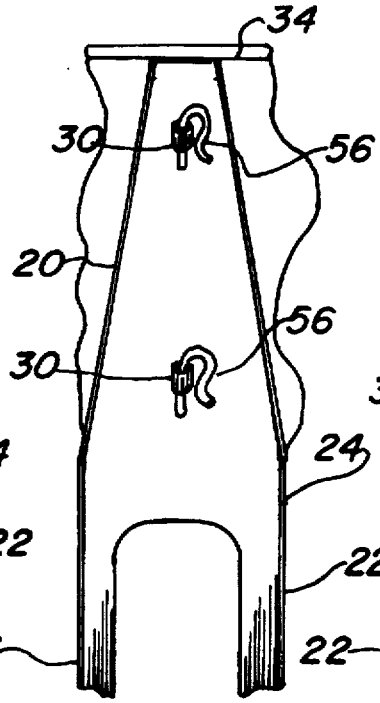
FIG. 17 is a partial isometric view of the rear of the carriage attached to the gudgeons with a pair of hairpin cotters.
Figure 18:
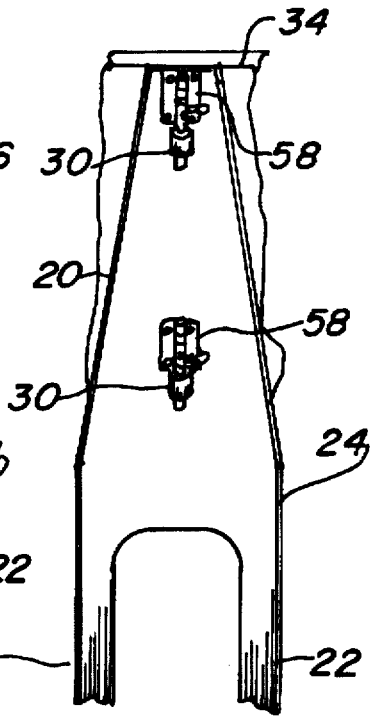
FIG. 18 is a partial isometric view of the rear of the carriage attached to the gudgeons with a pair of barrel bolts.

With this third embodiment the front of the upright 24 is open and accessible, therefore, different approaches to the gudgeon retaining means may be utilized. Instead of the one-piece bent rod 44, a pair of bent pins 54 may be utilized, as shown in FIG. 16. Further, hairpin cotters 56, as illustrated in FIG. 17, may be used. FIG. 18 depicts yet another approach using a pair of barrel bolts 58 for attachment. It will be noted that these alternates to the rod 44 are all commercially available and relatively inexpensive in quantity.

In use, the preferred embodiment requires removal of the rudder and placing the dolly over the gudgeons 30 and inserting the rod 44 through the holes. The rod is held captive in a vertical position by the handle portion 46 and the tension of the bow 50. The boat may then be lifted up by one person from the bow and wheeled to the water where the dolly may be removed from inside or outside of the boat.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

What is claimed is:

1. A portage dolly for a boat having rudders mounting gudgeons comprising:

a bifurcated carriage having a pair of downwardly distending legs attached to an upright frame member that includes gudgeon receiving apertures, said bifurcated carriage further comprises formed corrosion resistant sheet metal, an axle disposed between the downwardly distending legs and penetrating therethrough, axle retaining means removably attaching the axle to the legs, a wheel rotatably disposed upon said axle, and gudgeon retaining means, that comprise a pair of hairpin cotters removably joining the dolly to the boat when the boats rudder is removed, said apertures in the carriage mated over the boats rudder gudgeons, the gudgeons penetrated with the retaining means such that the retaining means jointly embrace both the gudgeons and carriage in an intimate manner, permitting the boat to be manually lifted and rolled in wheelbarrow fashion over land for portage.

2. A portage dolly for a boat having rudder mounting gudgeons comprising:

a bifurcated carriage having a pair of downwardly distending legs attached to an upright frame member that includes gudgeon receiving apertures, said bifurcated carriage further comprises formed corrosion resistant sheet metal, an axle disposed between the downwardly distending legs and penetrating therethrough, axle retaining means removably attaching the axle to the legs, a wheel rotatable disposed upon said axle, and gudgeon retaining means, comprising a pair of barrel bolts, removably joining the dolly to the boat when the boats rudder is removed, said apertures in the carriage mated over the boats rudder gudgeons, the gudgeons penetrated with the retaining means such that the retaining means jointly embrace both the gudgeons and carriage in an intimate manner, permitting the boat to be manually lifted and rolled in wheelbarrow fashion over land for portage.

3. A portage dolly for a boat that contains rudder mounting gudgeons comprising:

a bifurcated carriage having a pair of downwardly distending legs attached to an upright frame member that includes gudgeon receiving apertures, an axle disposed between the downwardly distending legs and penetrating therethrough, axle retaining means removably attaching the axle to the legs, a wheel rotatably disposed upon said axle, and gudgeon retaining means comprising a bent rod having a handle portion bent at an obtuse angle on a first end and a bevel on a second end with a bow inbetween removably joining the dolly to the boat when the boats rudder is removed, said apertures in the carriage mated over the boats rudder gudgeons, the gudgeons penetrated with the retaining means such that the retaining means jointly embrace both the gudgeons and carriage in an intimate manner maintaining tension between the rudder gudgeons and carriage when penetrated therethrough, permitting the boat to be manually lifted and rolled in wheelbarrow fashion over land for portage.

* * * * *